US006948462B2

(12) United States Patent
Engelberg

(10) Patent No.: US 6,948,462 B2
(45) Date of Patent: Sep. 27, 2005

(54) DEVICE FOR THE CONTROL OF AT LEAST ONE GAS EXCHANGE VALVE

(75) Inventor: Ralph Engelberg, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/466,395

(22) PCT Filed: Sep. 19, 2002

(86) PCT No.: PCT/DE02/03518

§ 371 (c)(1),
(2), (4) Date: Jan. 23, 2004

(87) PCT Pub. No.: WO03/042509

PCT Pub. Date: May 22, 2003

(65) Prior Publication Data

US 2004/0103868 A1 Jun. 3, 2004

(30) Foreign Application Priority Data

Nov. 13, 2001 (DE) ..... 101 55 669

(51) Int. Cl.[7] ..... F01L 9/02

(52) U.S. Cl. ..... 123/90.12; 123/90.15; 123/90.16

(58) Field of Search ..... 123/90.11, 90.12, 123/90.15–90.18, 90.28; 91/365, 374, 378, 52, 469

(56) References Cited

U.S. PATENT DOCUMENTS

| | | | | |
|---|---|---|---|---|
| 2,785,667 A | | 3/1957 | Miller | |
| 3,683,874 A | | 8/1972 | Berlyn | |
| 5,152,258 A | | 10/1992 | Nunzio | |
| 5,375,419 A | * | 12/1994 | Wright et al. | 60/607 |
| 5,857,438 A | * | 1/1999 | Barnard | 123/90.16 |

FOREIGN PATENT DOCUMENTS

| | | |
|---|---|---|
| DE | 30 14 028 | 10/1981 |
| DE | 198 26 047 | 12/1999 |
| EP | 0 909 883 | 4/1999 |
| FR | 2 287 583 | 5/1976 |
| JP | 59 037 222 | 2/1984 |

OTHER PUBLICATIONS

Bosch, "Automotive Handbook", 23rd ed., ISBN 3–528–03876–4, pp. 542 and 543 *, Described in the Specification.

* cited by examiner

*Primary Examiner*—Thomas Denion
*Assistant Examiner*—Jaime Corrigan
(74) *Attorney, Agent, or Firm*—Kenyon & Kenyon

(57) ABSTRACT

A device is indicated for controlling at least one gas exchange valve for an combustion cylinder of an internal combustion engine, having an hydraulic actuator for valve actuation and having a high-pressure pump that supplies the actuator with a pressure medium. In order to reduce the production costs, the high-pressure pump is formed as a control-sleeve pump having a stroke-driven pump plunger that limits a pump chamber, and having a spool valve surrounding this plunger. In the pump plunger and spool valve, on the one hand a control groove that runs obliquely to the stroke direction is provided, and on the other hand a spill opening that cooperates therewith is provided, which together bring about a relief of pressure of the pump chamber when they overlap. For the controlling of the phase position and duration of the valve actuation, the pump plunger and the spool valve are able to be rotated relative to one another, and the spool valve is able to be displaced relative to the pump plunger.

15 Claims, 2 Drawing Sheets

DEVICE FOR THE CONTROL OF AT LEAST ONE GAS EXCHANGE VALVE

FIELD OF THE INVENTION

The present invention is based on a device for controlling at least one gas exchange valve that is allocated to a combustion cylinder of an internal combustion engine.

BACKGROUND INFORMATION

A known device of this type (German Published Patent Application No. 198 26 047) has, as an actuator or valve positioner, a double-acting hydraulic working cylinder in which a control piston is guided so as to be axially displaceable, this control piston being fixedly connected with the valve shaft of the gas exchange valve integrated in the combustion cylinder, or itself forming the end thereof further away from the valve closing element. In the working cylinder, the control piston limits, with its two end surfaces facing away from one another, an upper and lower working chamber. While the lower working chamber, via which a piston displacement in the direction of valve closing is effected, is constantly charged with a medium under high pressure, for example hydraulic oil, the upper working chamber, via which a piston displacement in the direction of valve opening is effected, is purposively charged with pressure medium that is under high pressure, or is again relieved of stress to approximately ambient pressure, with the aid of electric control valves, preferably 2/2-way magnetic valves. The pressure medium under high pressure is supplied by a high-pressure pump. Of the control valves, a first control valve connects the first working chamber with the high-pressure pump, and a second control valve connects the upper working chamber with a relief line that debouches into a pressure medium reservoir. In the closed state of the gas exchange valve, the upper working chamber is separated from the closed first control valve by the high-pressure pump, and is connected with the relief line via the opened second control valve, so that the control piston is guided into its closed position by the pressure of the medium prevailing in the lower working chamber. For the opening of the gas exchange valve, the control valves are switched over, through which the upper working chamber is closed off from the relief line and is connected to the high-pressure pump. Because the piston area of the control piston in the upper working chamber is larger than the effective surface of the control piston in the lower working chamber, the control piston is displaced so as to open the gas exchange valve. The magnitude of the opening stroke depends on the design of the electrical control signal applied to the first control valve, and the speed of opening depends on the high pressure of the pressure medium, applied by the high-pressure pump.

From German Published Patent Application No. 30 14 028, a fuel injection pump for internal combustion engines is known that has a pumping and distribution plunger that simultaneously executes a back-and-forth stroke motion and a rotational motion. The pumping and distribution plunger, formed as a stepped piston, limits a pump chamber. In the jacket surface of the pumping and distribution plunger, there is situated a distribution longitudinal groove that is connected with the pump chamber and that, during rotation, successively activates pressure passages that lead to pressure lines that are connected with the internal combustion engine. The number of pressure passages corresponds to the number of combustion cylinders in the internal combustion engine that are to be supplied. During the rotation of the pumping and distribution plunger, the pressure passages that are not under high pressure are successively relieved of pressure, to a suction chamber, via one or more longitudinal grooves, an annular groove, and a relief bore. The regulation of the injected fuel quantity takes place via a spool valve that is situated on the pumping and distribution plunger in axially displaceable fashion and can be axially displaced by an hydraulic controller. The pumping chamber is connected, via bored holes in the pumping and distribution plunger, with longitudinal grooves situated on the jacket surface thereof that work together with an opening in the spool valve. As long as these bored holes are controlled to open by the molded opening via the longitudinal grooves, no injection takes place. However, as soon as these bored openings are blocked, and simultaneously, during the pressure stroke of the pumping and distribution plunger, the distribution longitudinal groove coincides with one of the pressure passages, injection takes place. The injected quantity is thus determined by the spacing of the longitudinal grooves, at least one of the longitudinal grooves being situated obliquely to the other, so that an axial displacement of the spool valve causes an alteration of the activation distance, and thus of the injected quantity.

Through further rotation of the spool valve, the beginning and end of the injection are simultaneously displaced.

What is known as a control-sleeve in-line fuel-injection pump is known for diesel engines (Bosch, "Automotive Handbook", 23rd ed., ISBN 3-528-03876-4, pp. 542 and 543), having, for each combustion cylinder of the diesel engine, a pump plunger that limits a pump chamber and is driven by a cam and that has an oblique control groove that is connected with the pump working chamber, and what is known as a control sleeve that is provided with a spill port. A setting shaft having a plurality of control-sleeve levers, of which each engages in a respective control sleeve, moves all the control sleeves in common. An electromagnetic actuator mechanism in turn rotates the setting shaft. According to the position of the control sleeve, the delivery begins earlier or later relative to the actuating cam. The delivery end is achieved when the control groove and the spill port coincide.

SUMMARY OF THE INVENTION

The device according to the present invention for controlling at least one gas exchange valve allocated to a combustion cylinder of an internal combustion engine has the advantage that through the combination of the production of pressure on the one hand and the controlling of the opening stroke and of the time of opening of the gas exchange valve in the control-sleeve pump on the other hand, the outlay of control valves and- control electronics, as well as functional software, is reduced. The control-sleeve pump used is a mature component that has proven its effectiveness in fuel-injection systems for internal combustion engines, e.g. as an element of the control-sleeve in-line fuel-injection pump described above, and thus has low susceptibility to failure. Its installation is simple. Through the savings of electrical control valves, the electronic outlay in the control apparatus is also reduced, and the energy consumption is lowered. Given a plurality of gas exchange valves in the internal combustion engine, each having an associated control device, both the load control and the phase displacement of all the gas exchange valves can be carried out through identical rotation of the pump plungers, or identical axial displacement of the spool valves of all the control devices. A switching off of the valves or of the cylinders of the internal combustion engine can be realized using additional simple electrical control valves having a low switching time requirement.

According to a preferred specific embodiment of the present invention, the control groove is incorporated into the jacket of the pump plunger, and is connected with the pump chamber via a connecting bore that runs in the pump plunger, while the spill opening in the spool valve is realized in the form of a radial bore. Through axial displacement of the spool valve, the phase position of the opening of the gas exchange valve, i.e., the time of opening relative to that of the other gas exchange valves, is adjusted, and through rotation of the pump plunger the duration of the opening of the gas exchange valve is adjusted.

According to an advantageous specific embodiment of the present invention, a non-return valve is situated between the pump chamber and the pump outlet, and a relief opening that can optionally be shut off using an electrically controllable shutoff valve is connected to the pump outlet. The shutoff valve is preferably formed as a 2/2-way magnetic valve having a spring return mechanism. In this way, the opening of the gas exchange valve can be executed with a variable stroke, the non-return valve connected before the pump outlet preventing an immediate intake of the gas exchange valve at the spill of the control-sleeve pump, so that the instantaneous stroke of the gas exchange valve is maintained. The opening of the shutoff valve at the correct time triggers the closing process of the gas exchange valve by the valve closing spring. Through these measures, a fully variable valve gear is achieved, with which, given a small load-of the gas exchange valve, opening takes place only for an extremely short time, in order to admit only a very small quantity of fresh gas into the combustion cylinder, in order to lower fuel consumption. Such an extremely short opening of the gas exchange valve is possible only through a super-proportional reduction of the valve stroke. Through the constant holding open of the shutoff valve, the gas exchange valve can be kept constantly closed, and a valve or cylinder shutting off can be realized in the internal combustion engine.

If variable stroke control is omitted, in a simplified embodiment of the control device according to the present invention, instead of the non-return valve and electrically controlled shutoff valve a simple pressure limiter or overflow valve, which opens mechanically when there is excess pressure, can be connected to the pump outlet of the control-sleeve pump. This simplified and more economical version of the control device can advantageously be used for the controlling of the discharge valves, because here a variable opening stroke is of no particular interest.

According to an advantageous specific embodiment of the present invention, given a plurality of gas exchange valves to each of which an actuator is allocated for valve actuation, the actuators for selected gas exchange valves situated in different combustion cylinders can be connected to a common control-sleeve pump, resulting in an additional savings of cost. Here, for each two actuators a switchover valve is provided, such that one actuator is connected to each of the two valve outlets thereof, and the valve input thereof, which can optionally be connected with the valve outlets, is adjacent to the pump outlet of the control-sleeve pump. The switchover valve is preferably fashioned as a 3/2-way magnetic valve having a spring return mechanism.

DETAILED DESCRIPTION

Figure 1:
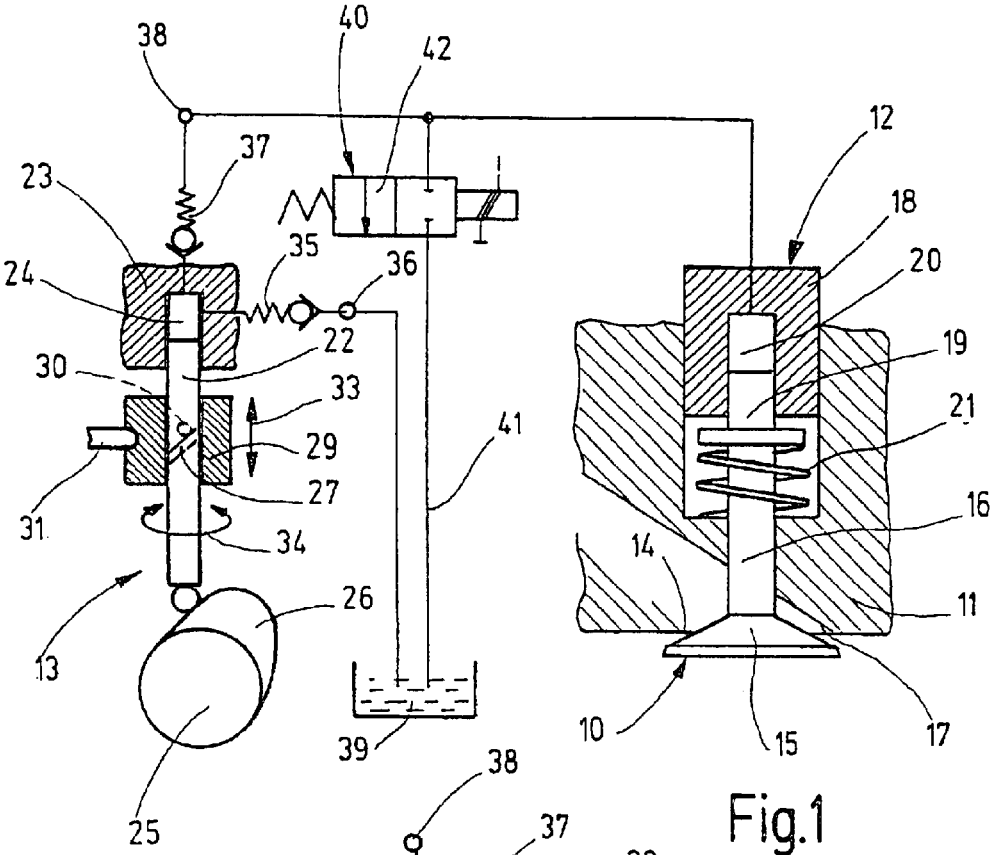
FIG. 1 shows a diagram of a device for controlling a gas exchange valve.

The device shown in the diagram in FIG. 1 for controlling a gas exchange valve 10 for a combustion cylinder—shown partially with its cylinder head 11—of an internal combustion engine in motor vehicles has an hydraulic actuator 12 for valve actuation and a high-pressure pump, formed as a control-sleeve pump 13, that charges actuator 12 with a medium under high pressure, e.g. hydraulic oil.

Gas exchange valve 10, situated in cylinder head 11 of the combustion cylinder, can be an intake valve or an outlet valve. It has, in a known manner, a valve element 15 that closes a valve opening 14 and that formed on a valve shaft 16 and cooperates with a valve seat 17 surrounding valve opening 14.

Actuator 12 has a control piston 19 that is guided in displaceable fashion in a working cylinder 18, and that limits an hydraulic working chamber 20 and is coupled with valve shaft 16 of gas exchange valve 10, and is fashioned in one piece with this shaft in the exemplary embodiment. In order to open gas exchange valve 10, control piston 19 is displaced against the force of a valve closing spring 21 by medium that is under high pressure and that is introduced into hydraulic working chamber 20 by control-sleeve pump 13.

Figure 2:
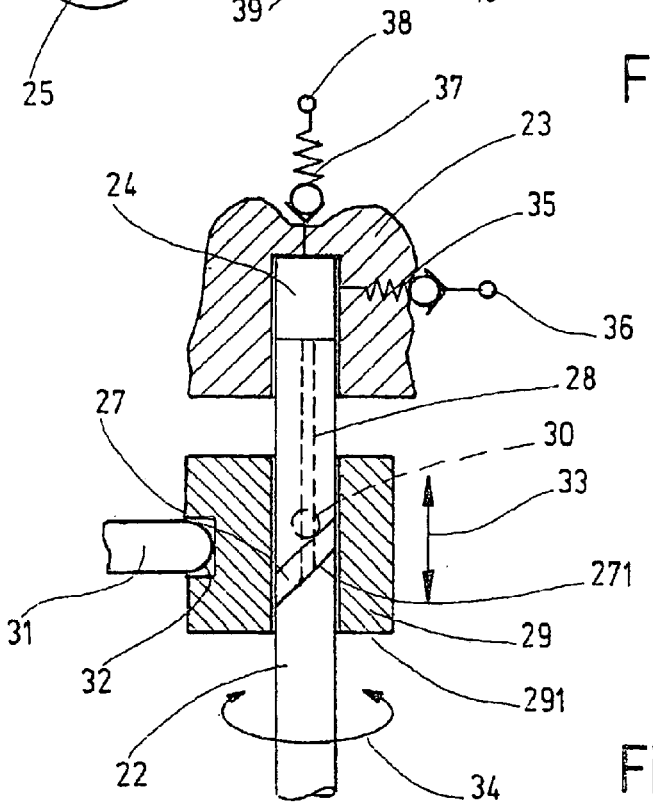
FIG. 2 shows an enlarged sectional view of a control-sleeve pump in the control device according to FIG. 1.

Control-sleeve pump 13 has a pump plunger 22 that limits, in a pump cylinder 23, a pump chamber 24, and is driven to execute a stroke motion by a carn 26 that is situated in rotationally rigid fashion on a camshaft 25, when camshaft 25 rotates. As can be seen more clearly in the enlarged view of control-sleeve pump 13 in FIG. 2, in the jacket of pump plunger 22 there is incorporated a control groove 27 that runs obliquely to the stroke direction of pump plunger 22, i.e., at an acute angle to the pump plunger axis, and that is connected with pump chamber 24 via a blind bored hole 28 situated axially in pump plunger 22, in a connection that permits the exchange of pressure medium. Control-sleeve pump 13 additionally has a spool valve 29 that surrounds pump plunger 22. In spool valve 29, a spill opening 30 is made in the form of a radial bore, shown in FIG. 2 in broken lines, because in the sectional representation it is situated in the cut-away half of annular spool valve 29. If, during the stroke of pump plunger 22, control groove 27 and spill opening 30 overlap, pressure medium can flow out of pump chamber 24, which relieves pump chamber 24 of pressure. As is indicated symbolically by arrow 33, spool valve 29 can be displaced axially on pump plunger 22, for which purpose an actuating lever 31 of a controller engages in a guide groove 32 on the outer periphery of spool valve 29. As is indicated by arrow 34 in FIG. 2, pump plunger 20 is fashioned so as to be able to be rotated about its axis. For the rotation of pump plunger 22, an actuating element (not shown) engages thereon. Through this rotational adjustment of pump plunger 22, the duration of opening of gas exchange valve 10 is altered, while through displacement of spool valve 29 it is possible to influence the phase position of the opening of gas exchange valve 10, i.e., the time at which gas exchange valve 10 is opened relative to a reference time.

Pump chamber 24 is connected with a pump inlet 36 via a pump inlet valve 35, formed as a non-return valve, and is connected with a pump outlet 38 via a non-return valve 37 whose blocking direction is oriented towards pump chamber 24. Pump inlet 36 is connected to a pressure medium reservoir 39, and pump outlet 38 is connected to hydraulic working chamber 20 of actuator 12.

For the controlling of a variable stroke of gas exchange valve 10 for the purpose of achieving an extremely short opening duration of the gas exchange valve in partial load and low load operation of the internal combustion engine, there is connected to pump outlet 38 an additional relief opening that can be optionally closed by an electrically controllable closing valve 40. In the exemplary embodiment shown in FIG. 1, the relief opening is connected with a return line 41 that leads to pressure medium reservoir 39, and a 2/2-way magnetic valve 42 having a spring return mechanism is used as shutoff valve 40. This magnetic valve 42 is for example formed so as to be open without current, and, for an opening stroke of gas exchange valve 10 that is to be introduced, is led into its closed position by a control device (not shown), by being supplied with current. If, during the activation process of gas exchange valve 10, the current to magnetic valve 42 is switched off, magnetic valve 42 opens, and triggers, through the relief of hydraulic working chamber 20, the closing process of gas exchange valve 10 by valve closing spring 21.

The operation of the control device is as follows:

Upon rotation of camshaft 25, pump plunger 22 is driven by cam 26 to execute a continuous back-and-forth stroke motion, such that when there is a downward-directed stroke motion pump chamber 24 is filled with pressure medium from pressure medium reservoir 39 via pump inlet 36 and pump inlet valve 35. During the upward-directed stroke motion, as soon as lower edge 291 of spool valve 29 closes the lower edge of control groove 27, called control edge 271, pressure builds up in pump chamber 24. Via pump outlet 38, this pressure is introduced into hydraulic working chamber 20 of actuator 12, through which control piston 19 is displaced against the spring force of valve closing spring 21, and gas exchange valve 10 is opened. If spill opening 30 made in spool valve 29 overlaps with control edge 271, this pressure is relieved, through which the spill of control-sleeve pump 13 is achieved. After the spill, non-return valve 37 prevents the immediate intake of gas exchange valve 10, so that the instantaneous valve stroke is maintained. If now, or at an earlier time, i.e. already during the delivery stroke of control-sleeve pump 13, the current is shut off to magnetic valve 42, which is closed when supplied with current, then at the desired time return line 41 to pressure medium 39 reservoir opens, which triggers an immediate closing of gas exchange valve 10 by valve closing spring 21.

Figure 3:
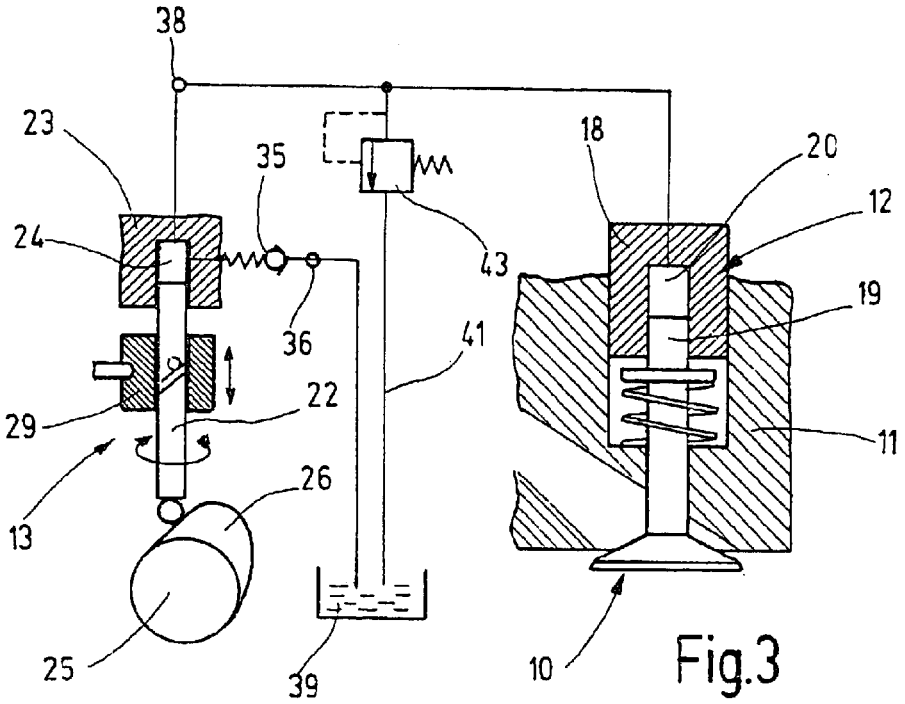
FIG. 3 in the same representation as in FIG. 1, shows a simplified version of the control device.

The control device shown in a block diagram in FIG. 3 is modified in relation to the control device described by FIG. 1 in that the non-return valve between pump chamber 24 and pump outlet 38 has been omitted, and return line 41 to pressure medium reservoir 39 is connected to pump outlet 38 not via an electrically controllable shutoff valve, but rather via a simple pressure limiter or overflow valve 43, which opens mechanically when there is excess pressure. In this case, in contrast to the case shown in FIG. 1 with magnetic valve 42, a variable stroke cannot be controlled, but the opening and closing time, i.e. the duration and phase position of the opening of gas exchange valve 10, can, as described, be varied via the axial displacement of spool valve 29 and the rotation of pump plunger 22. In other respects, the exemplary embodiment according to FIG. 3 corresponds to the exemplary embodiment according to FIG. 1, so that identical components have been provided with identical reference characters.

In the case of gas exchange valves 10, an actuator 12 is allocated to each gas exchange valve 10, and actuators 12 can be connected to a common control-sleeve pump 13 by selected gas exchange valves 10 situated in various combustion cylinders 11. A precondition of this is that the opening times of the various gas exchange valves 10 do not overlap.

Figure 4:
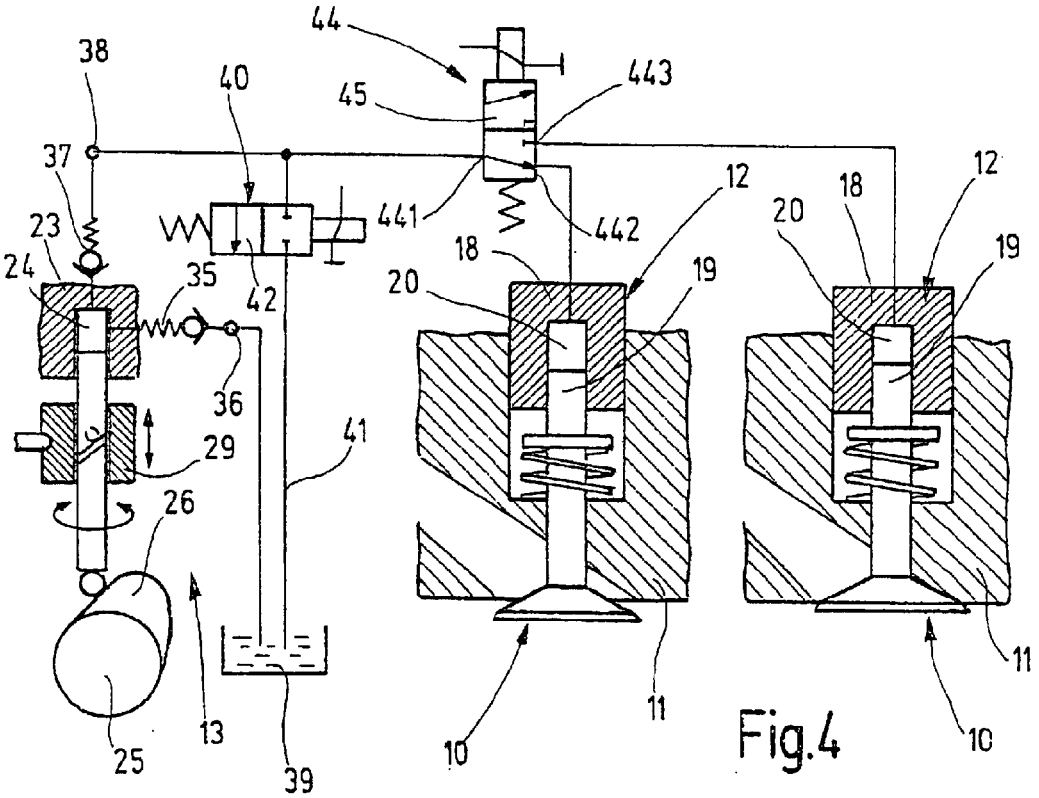
FIG. 4 shows a diagram of the control device for controlling gas exchange valves allocated to two different combustion cylinders.

As is shown in the exemplary embodiment according to FIG. 4 of the control device for two gas exchange valves 10 situated in different combustion cylinders, an actuator 12 is allocated to each gas exchange valve 10, and in addition a switchover valve 44 is provided that has two valve outlets 442, 443 and has a valve inlet 441 that can optionally be connected with valve outlets 442, 443. In the exemplary embodiment shown in FIG. 4, switchover valve 44 is formed as a 3/2-way magnetic valve 45 having a spring return mechanism. An hydraulic working chamber 20 of an actuator 12 is connected with a respective valve output 442 or 443, while valve inlet 441 is adjacent to pump outlet 38. In the representation shown in FIG. 4, the upward motion of pump plunger 22 of control-sleeve pump 13 in its pump chamber 24 results in the buildup of a high pressure that has been introduced into hydraulic working chamber 20 of actuator 12 (shown at the left in FIG. 4) due to the switching position of switchover valve 44, and has resulted in an opening motion of valve element 10. Hydraulic working chamber 20 of actuator 12 (shown at right in FIG. 4) is shut off by switchover valve 44 and is without pressure, so that gas exchange valve 10 (at the right in FIG. 4) is in its closed position. For the controlling of gas exchange valve 10 (at the right in FIG. 4), switchover valve 44 is to be switched over, which represents only a small demand in terms of switching time. In other respects, the design and manner of operation of the control device according to FIG. 4 correspond to those shown in FIG. 1, so that identical components have been provided with identical reference characters.

The invention is not limited to the exemplary embodiment described above. Thus, the rotational movability of pump plunger 22 can be omitted, and instead spool valve 29 can have, in addition to its capacity for axial displacement, a rotational controlling. The situation of control groove 27 and spill opening 30 in pump plunger 22 and spool valve 29 can be exchanged.

What is claimed is:

1. A device for controlling at least one gas exchange valve allocated to a combustion cylinder of an internal combustion engine, comprising:

a hydraulic actuator for performing a valve actuation; and a high-pressure pump that charges the hydraulic actuator with a pressure medium under high pressure, wherein:

the high-pressure pump includes a control-sleeve pump provided with a pump plunger that executes a stroke motion and that limits a pump chamber, the high-pressure pump includes a spool valve that surrounds the pump plunger, one of the pump plunger and the spool valve includes a control groove that runs obliquely to a stroke direction of the pump plunger, another one of the pump plunger and the spool valve includes a spill opening that works together with the control groove so that when the spill opening and the control groove overlap, a relief of pressure of the pump chamber is achieved, the pump plunger and the spool valve are able to be rotated relative to one another, and the spool valve is able to be displaced relative to the pump plunger, for a controlling of a phase position and a duration of an activation of the at least one gas exchange valve through an activation and deactivation of the hydraulic actuator.

2. The device as recited in claim 1, wherein:

the control groove is incorporated in a jacket of the pump plunger and is connected with the pump chamber via a connecting bore that runs in the pump plunger, and the spill opening is situated in the spool valve and is formed as a radial bore.

3. The device as recited in claim 1, further comprising:

a pressure medium reservoir connected to a pump inlet of the pump chamber; and a pump inlet valve situated between the pump chamber and the pump inlet, wherein:

the pump chamber includes a pump outlet connected with the hydraulic actuator.

4. The device as recited in claim 3, wherein:

the pump inlet valve includes a non-return valve.

5. The device as recited in claim 3, wherein:

the hydraulic actuator includes a control piston that is coupled with the at least one gas exchange valve, that limits a hydraulic working chamber, and that is able to be displaced against a valve closing spring by the pressure medium introduced into the hydraulic working chamber, and the hydraulic working chamber is connected to the pump outlet.

6. The device as recited in claim 3, further comprising:

a cam shaft; and a cam situated on the cam shaft, wherein:

the pump plunger is driven to execute the stroke motion via the cam.

7. The device as recited in claim 3, further comprising:

a pressure limiting valve connected to the pump outlet.

8. The device as recited in claim 3, further comprising:

a non-return valve situated between the pump chamber and the pump outlet; and an electrically controllable shutoff valve, wherein:

a relief opening that is able to be closed optionally by the electrically controllable shutoff valve is connected to the pump outlet.

9. The device as recited in claim 8, wherein:

the electrically controllable shutoff valve includes a 2/2-way magnetic valve having a spring return mechanism.

10. The device as recited in claim 9, further comprising:

a return line that leads to the pressure medium reservoir and is connected to the relief opening.

11. The device as recited in claim 1, wherein:

the pump plunger is rotatable.

12. A device for controlling a plurality of gas exchange valves allocated to combustion cylinders of an internal combustion engine, comprising:

a plurality of hydraulic actuators, each one of the hydraulic actuators being allocated to a respective one of the gas exchange valves for performing a valve actuation; and a high-pressure pump that charges each hydraulic actuator with a pressure medium under high pressure, wherein:

the high-pressure pump includes a common control-sleeve pump provided with a pump plunger that executes a stroke motion and that limits a pump chamber, the common control-sleeve pump being connected to the hydraulic actuators, the high-pressure pump includes a spool valve that surrounds the pump plunger, one of the pump plunger and the spool valve includes a control groove that runs obliquely to a stroke direction of the pump plunger, another one of the pump plunger and the spool valve includes a spill opening that works together with the control groove so that when the spill opening and the control groove overlap, a relief of pressure of the pump chamber is achieved, the pump plunger and the spool valve are able to be rotated relative to one another, and the spool valve is able to be displaced relative to the pump plunger, for a controlling of a phase position and a duration of an activation of the gas exchange valves through an activation and deactivation of each hydraulic actuator.

13. The device as recited in claim 12, further comprising:

a switchover valve for connecting the hydraulic actuators to the common control-sleeve pump, wherein:

the switchover valve includes a valve inlet that is able to be connected optionally with two valve outlets, one of the hydraulic actuators is connected with each of the two valve outlets, and the valve inlet is adjacent to a pump outlet of the pump chamber.

14. The device as recited in claim 13, wherein:

the switchover valve includes a 3/2-way magnetic valve having a spring return mechanism.

15. The device as recited in claim 12, wherein:

the pump plunger is rotatable.

* * * * *